United States Patent [19]

Lewis

[11] 4,400,918

[45] Aug. 30, 1983

[54] FOAM/FOIL BACKER FOR SIDING AND SIDING ASSEMBLY AND METHOD FOR MAKING SAME

[76] Inventor: Eugene R. Lewis, 9 Candee Rd., Prospect, Conn. 06712

[21] Appl. No.: 326,155

[22] Filed: Nov. 30, 1981

[51] Int. Cl.[3] ..... E04C 1/34

[52] U.S. Cl. ..... 52/98; 428/161; 156/220; 52/528; 52/545

[58] Field of Search ..... 52/98–100, 52/276, 428, 407, 408, 518, 528, 540, 545, 631, 746–748; 428/159–161, 167; 156/220, 221, 297

[56] References Cited

U.S. PATENT DOCUMENTS

| | | | |
|---|---|---|---|
| 1,461,337 | 7/1923 | Weiss | 428/166 |
| 1,711,471 | 4/1929 | Curran | 52/631 |
| 3,001,332 | 9/1961 | Wilder | 52/303 |
| 3,084,403 | 4/1963 | Elmendorf | 52/99 |
| 3,159,943 | 12/1964 | Sugar et al. | 52/278 |
| 3,304,676 | 2/1967 | Sallie et al. | 52/276 |
| 3,455,076 | 7/1969 | Clarvoe | 52/408 |
| 3,458,962 | 8/1969 | Kendall | 52/309.1 |
| 3,485,004 | 12/1969 | Mattes | 52/520 |
| 3,504,467 | 4/1970 | Hatch et al. | 52/309.1 |
| 3,520,099 | 7/1970 | Mattes | 52/531 |
| 3,552,078 | 1/1971 | Mattes | 52/278 |
| 3,731,449 | 5/1973 | Kephart | 428/256 |
| 3,900,550 | 8/1975 | Oliver et al. | 428/167 |
| 3,998,021 | 12/1976 | Lewis | 52/531 |
| 4,033,802 | 7/1977 | Culpepper, Jr. et al. | 156/71 |
| 4,070,719 | 1/1978 | Morgan | 428/167 |
| 4,081,939 | 4/1978 | Culpepper, Jr. et al. | 52/535 |
| 4,157,413 | 6/1979 | Ruhl | 428/159 |

FOREIGN PATENT DOCUMENTS

| | | | |
|---|---|---|---|
| 988673 | 5/1976 | Canada | 52/528 |

*Primary Examiner*—James L. Ridgill, Jr.

[57] ABSTRACT

A dual-purpose backerboard member is provided which has a weakening line dividing it longitudinally into two sections, and which has a barrier sheeting bonded to one face of the cellular backerboard except along the weakening line. The panel member can readily be split along the weakening line without damage to the barrier sheeting laminated thereto, due to the provision of the unbonded zone. The backer member can be used intact for a single-lap siding panel; alternatively it can be split and assembled with a double-lap panel, in which assembly the two sections are overlapped and hingedly interconnected by the bridging web of the sheeting, and are installed against the offset wall portions of the panel.

9 Claims, 6 Drawing Figures

FOAM/FOIL BACKER FOR SIDING AND SIDING ASSEMBLY AND METHOD FOR MAKING SAME

BACKGROUND OF THE INVENTION

Many siding panels for buildings are generally of aluminum or vinyl construction; they are most often made to a standard eight-inch width, and in either a single- or double-lap configuration, the latter commonly being referred to as a "4/4" or "double-4" panel. It is now conventional to back such panels with a backerboard made of a rigid cellular synthetic resinous material, such as expanded polystyrene, for thermal insulation as well as to provide structural support for the panels, which are susceptible to denting and bending. It is a standard practice to incorporate a moisture vapor barrier sheeting (normally aluminum foil) into the wall structure, and, when a backerboard is employed, it is advantageous to laminate the barrier sheeting directly thereto during the manufacturing procedure, rather than in the field. Doing so saves time and labor, and significantly reduces tearing and wrinkling of the foil, as often occurs when it is applied separately during the siding application procedure.

Most desirably, the installed backerboard will closely follow the internal contour of the vinyl or aluminum panel, since this provides maximum support and insulation while avoiding the formation of unduly large pockets of air space between the panel and the backerboard. It is relatively easy to achieve such a relationship in a single lap panel, simply by utilizing a backerboard of corresponding width. While, in a similar manner, each horizontal wall section of a double lap panel could be backed with a backerboard of the same width, such an approach would entail obvious disadvantages. For example, doing so would require that a variety of sizes of backerboard be stocked and transported; it would involve excessive handling and manipulation for application to the panel and to the wall structure; and it would make it impractical to provide a continuous moisture barrier between the pieces of backerboard within a single panel.

Certain of the foregoing factors have previously been appreciated, and backerboard constructions have been proposed in the art in an effort to achieve the recognized advantages. For example, in U.S. Pat. Nos. 4,033,802 and 4,081,939, Culpepper Jr. et al. describe a backerboard comprised of two elongated members fabricated from an insulating foam material and fastened together along their overlapped longitudinal edges. This construction presents a longitudinal edge on one of the members for abutment against the inner surface of the step that connects the two wall portions of the panel, and this is said to minimize the dead air space that results when the prior art backerboard structure, identified by the patentees, is used; it is also said to maximize the level of support for the longitudinal step of the panel. However, because the construction described by Culpepper, Jr., et al. is tailored to a specific configuration of double-lap siding panel, its utility is limited; moreover, manufacture of the backerboard described is not as facile, practical, or economical as it might be.

Accordingly, it is a primary object of the present invention to provide a novel dual-purpose backerboard, and a novel method for producing the same, which backerboard can readily be used in assembly with either a single-lap or a double-lap configuration of siding panel.

It is also an object of the invention to provide such a backerboard and method wherein the continuity of the moisture barrier sheeting laminated thereto is not disrupted, regardless of whether the backerboard is utilized in its single- or double-lap configuration.

Another object of the invention is to provide a method for the production of an assembly of a backerboard with a double-lap siding panel, and the novel assembly so produced.

Yet another object of the invention is to provide a novel backerboard construction which is facile and relatively inexpensive to produce, is convenient to install, and is highly effective for its intended purposes.

SUMMARY OF THE INVENTION

It has now been found that certain of the foregoing and related objects of the present invention are readily attained in a backerboard member comprised of an elongated insulating backerboard of cellular synthetic resin, having a weakening line extending along the length and substantially at the center of the height thereof, and a coextensive barrier sheeting bonded to one face of the backerboard. The barrier sheeting and backerboard are at least substantially free from bonding along a zone extending along and directly adjacent the weakening line in the backerboard, the width of which zone is greater than the thickness of the backerboard. As a result, the backerboard can be separated into two sections, and the barrier sheeting can readily be displaced from the backerboard along the bond-free zone, thereby permitting the adjacent edge portions of the separated sections to be overlapped without causing damage to, or discontinuity in, the connecting barrier sheeting.

Other objects of the invention are attained in a double-lap siding panel assembly consisting of the backerboard member hereinabove described, in combination with a double-lap siding panel, the latter consisting of upper and lower wall portions joined along their adjacent edges by a longitudinally extending offsetting step portion. In the assembly, the backerboard is separated, at the weakening line formed therein, into two sections; the adjacent edge portions of the sections are overlapped, with that of the outermost section lying along and adjacent the step portion of the panel. The sections of the backerboard are hingedly interconnected by the barrier sheeting, with the free portion thereof being displaced from the backerboard and forming a barrier web between the sections, which web is substantially coextensive with the offset step of the panel.

In preferred embodiments of the backerboard member, and of the assembly utilizing the same, the backerboard will be fabricated from a rigid cellular synthetic resinous material, which will generally be a thermoplastic, and most desirably expanded polystyrene. In such latter instances, the line of weakness will advantageously be formed by fusion of the thermoplastic, and most beneficially by fusing both sides of the backerboard to form a pair of aligned, inwardly-extending grooves which together produce an area of reduced cross-section. The laminated barrier sheeting will generally comprise aluminum foil, although plastic films, Kraft paper, and the like may also be used.

Additional objects of the invention are readily attained in a method for the production of a dual-purpose backerboard member, in which a weakening line is formed into an elongated backerboard to longitudinally bisect it into two sections, and a barrier layer is substantially fully laminated coextensively upon one face of thereof. The laminating step is effected while maintaining the barrier layer and backerboard free from bonding throughout a marginal zone that extends along and directly adjacent to the line of weakness, such that the backerboard member has the features and advantages previously described.

Yet further objects of the invention are achieved by a method for the production of a double-lap siding panel assembly, wherein a dual-purpose backerboard member is first produced in accordance herewith, which is then separated into two sections at the line of weakness formed therein. The split backerboard member is then assembled with a double-lap siding panel in such a manner that one of its sections is disposed against the inner surface of each of the wall portions of the panel, with the adjacent edge portions of the sections in a generally overlapped relationship. As so disposed, one of the fractured edges of the backerboard will be aligned behind the offsetting step of the panel, and the free portion of the barrier layer will provide a connecting web extending between the overlapped edges of the backerboard sections.

DETAILED DESCRIPTION OF THE PREFERRED AND ILLUSTRATED EMBODIMENT

Figure 1:
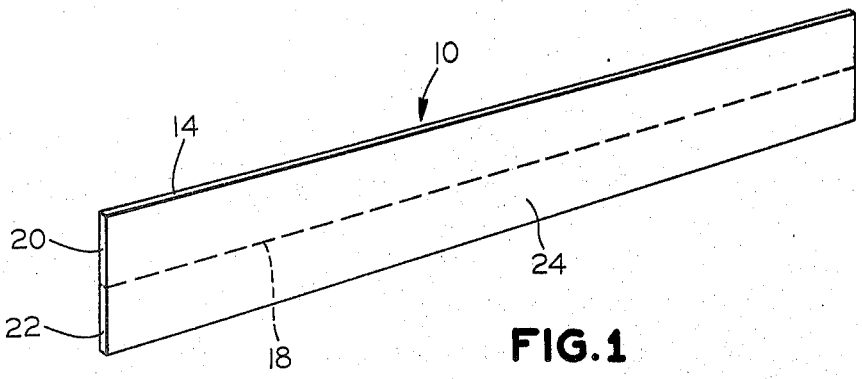
FIG. 1 is a perspective view of a backerboard member embodying the present invention.
Figure 2:
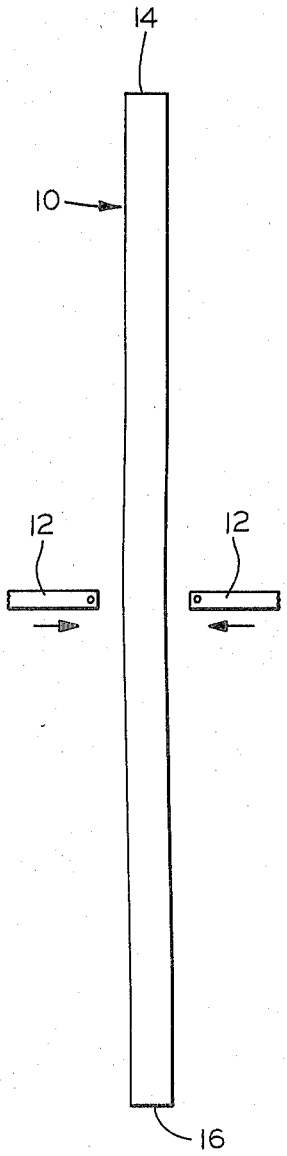
FIG. 2 is an end elevational view of a length of backerboard fabricated from a heat-fusible material, diagrammatically showing a pair of hot wire cutters on opposite sides of the backerboard in position to form a weakening line therein.
Figure 3:
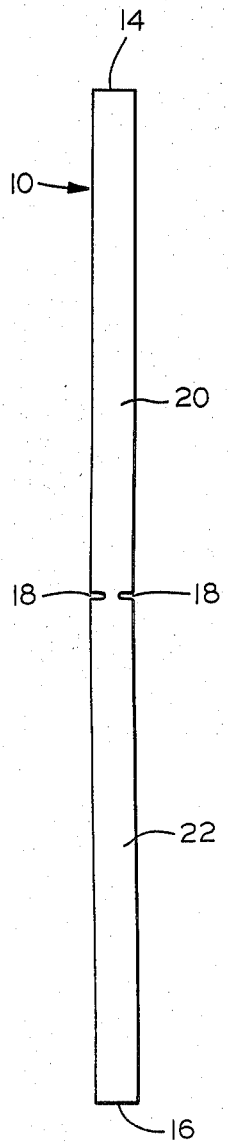
FIG. 3 is a view similar to that of FIG. 2, showing the formed weakening line and the backerboard sections so defined.
Figure 4:
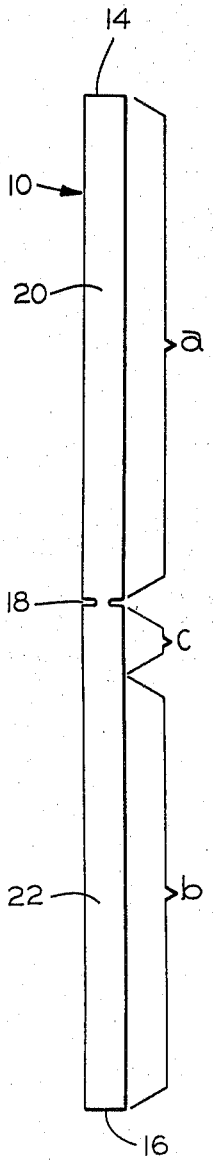
FIG. 4 is a view similar to those of FIGS. 2 and 3, in which are designated areas of the surface of the backerboard on which bonding of the moisture barrier sheeting is to be effected.

Turning now in greater detail to the appended drawings, from FIG. 1 it will be appreciated that the backerboard members of the invention are relatively thin, elongated structures of substantially rectangular configuration. In FIG. 2, the backerboard, generally designated by the numeral 10, is viewed endwise, and one of a pair of aligned, reciprocating hot wire cutters 12 is mounted (by means not shown) in front of and behind the backerboard 10, midway between the top and bottom edges 14, 16 thereof, respectively. The hot wires of the cutters 12 fuse the thermoplastic material from which the backerboard 10 is fabricated, forming along the entire length of the backerboard 10 a pair of confronting grooves 18, which are parallel to the edges 14, 16 and which reduce the cross section thereat to weaken the board and define a line of frangibility thereon (as in FIG. 3). The grooves 18 also define what may be regarded to be an upper section 20 and a lower section 22, and the areas designated in FIG. 4 by the brackets "a" and "b" constitute the portions of the front (outer) surface of the backerboard 10 over which the barrier sheeting is to be secured thereto. As will be noted, the area "b" on the lower section 22 is smaller than that of "a", leaving a narrow zone "c" adjacent the groove 18 at which the barrier layer is to be unsecured; the width of the zone "c" is somewhat greater than the thickness of the backerboard 10.

Figure 5:
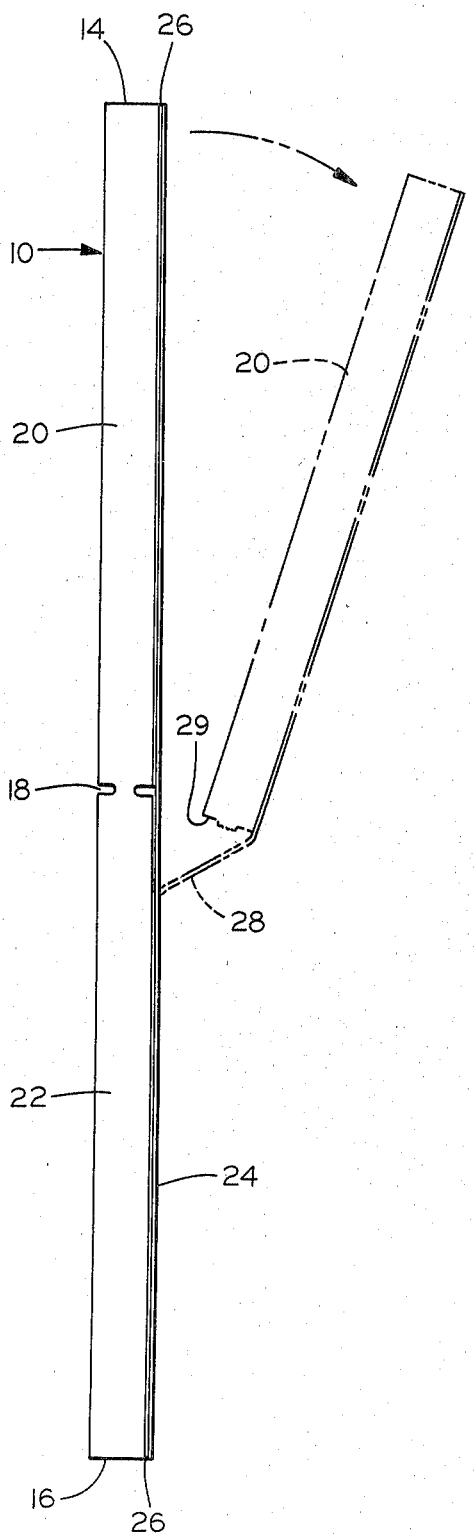
FIG. 5 is an end elevational view of the backerboard member of FIG. 1, drawn to an enlarged scale and showing (in phantom line) separation and displacement of the upper section thereof.

Turning now to FIG. 5, a coextensive layer 24 of barrier material is laminated to the outer face of the backerboard 10, and is bonded thereto in full surface contact, except within the marginal strip "c". Bonding is achieved with a film 26 of adhesive material which, it can be seen, does not extend into the area "c". The phantom-line representation shows the sections 20, 22 of the backerboard 10 separated from one another at the line of frangibility 18, with the upper section 20 displaced slightly from the lower. The portion of the barrier layer 24 overlying the zone "c" is also displaced from the corresponding surface, providing a connecting web 28 between the adjacent fractured inner edge portions 29, 30 of the upper and lower sections of the backerboard, respectively.

Figure 6:
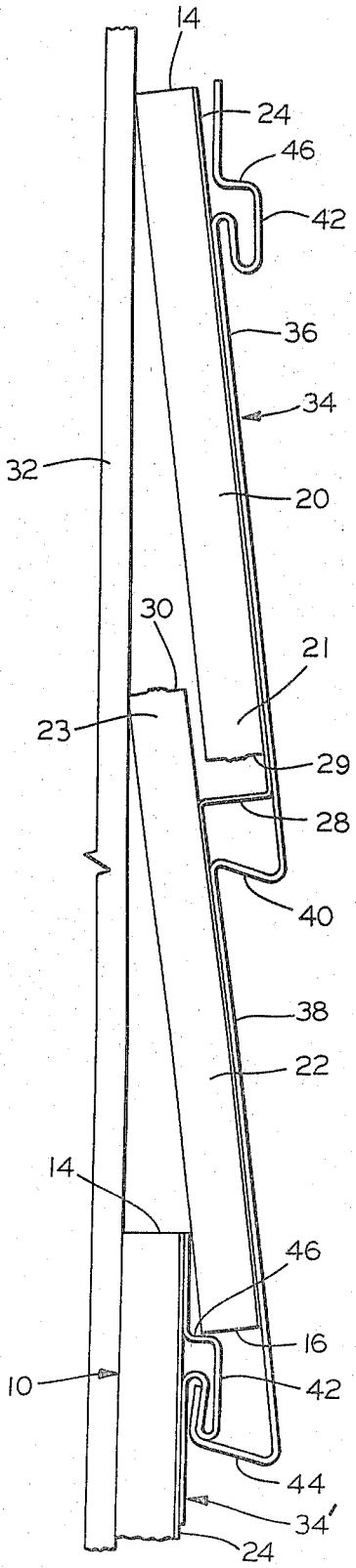
FIG. 6 is a fragmentary end elevational view of double-lap siding panel assemblies embodying the present invention, utilizing the backerboard member of the preceding Figures, and fastened to building wall structure.

The assembly shown in FIG. 6 consists of a siding panel, generally designated by the numeral 34, which is of a double-lap construction and consists of an upper wall 36, a lower wall 38, and a longitudinally extending offsetting connecting step portion 40 therebetween. As is conventional in such a panel, complementarily contoured, longitudinally extending hook portions 42, 44 are provided along the upper and lower margins, respectively, of the panel 34, which cooperate (in the manner illustrated near the bottom of FIG. 6) to provide a tight interlock with the adjacent panels, such as with underlying panel 34'. As installed within the panel 34 and fastened to the building wall structure 32, the lower section 22 of the backerboard member is positioned against the lower wall 38, with its lower edge 16 abutting upon the upper shoulder 46 of the contoured hook 42 of the underlying panel 34'; it extends upwardly therefrom, past the step 40 and into the region behind the upper wall 36 of the panel 34. The upper section 20 of the backerboard is similarly disposed within the wall 36, with its lower edge portion 21 overlaping the adjacent upper edge portion 23 of the section 22, and with its fractured edge 29 coextensive with the step portion 40 of the panel 34. The web portion 28 of the barrier layer 24 is interposed between the step portion 40 and the edge 29, and conforms substantially thereto. It can thus be seen that a substantially continuous insulating and barrier structure is provided, as a result of the overlap between the split sections 20, 22, and the continuity of the web portion 28 extending therebetween.

The embodiments described in connection with the drawings are illustrative and preferred; however, a considerable degree of variation in construction can be made without departing from the concepts of the invention. For example, while the backerboard itself will, as indicated above, generally be fabricated from a rigid thermoplastic foam, other materials may be utilized, provided that they exhibit suitable characteristics. The use of a thermoplastic is advantageous because, among other things, it enables the weakening line to be produced by a hot-wire cutting technique. However, the manner in which frangibility is achieved is not at all critical to the present invention, and other techniques, such as cutting or scoring with a blade or saw, may advantageously be utilized for the purpose. Moreover, the backboard need not fracture along a plane normal to its faces, but rather can do so at an angle thereto, should it be desirable, for example, to define an edge having a bevel corresponding to the angle at which the offsetting step of the associated panel is formed.

The dimensions of the backerboard are also not of critical significance to the invention, and will be dictated by the dimensions and configuration of the siding panel with which the backerboard is to be utilized. Although eight-inch wide panels are perhaps most extensively used, other sizes are also available, and the concepts of the invention are of course equally applicable thereto. It should be pointed out that a nominal eight-inch backerboard will generally be about nine inches wide to accommodate the configuration of the siding panel. Also, the board will be about $\frac{3}{8}$ to $\frac{1}{2}$ inch thick, and this dimension must be taken into account in determining the width of the unsecured zone along the line of frangibility, which will generally be greater than the board thickness (i.e., about $\frac{5}{8}$ inch for a $\frac{3}{8}$ inch backerboard).

Except to the extent that it influences the design of the backerboard member, the specific configuration of the siding panel is not critical to the invention, nor is the material from which it is fabricated. Similarly, the means by which the panels are joined to one another and are fastened to the building may vary as desired.

It should be noted that the backerboard members provided by the invention are well suited for either the in-plant manufacture of a siding panel assembly, or for on-site installation. In the former instance, it will generally be advantageous to fasten the backerboard member to the siding panel, to facilitate handling and shipment. On the other hand, considerable advantage is realized in assembling the backerboard members with the panels just prior to installation on the building, in which case they would be supplied separately, with the builder having the option of breaking the backerboard or leaving it intact, as appropriate.

Thus, it can be seen that the present invention provides a novel dual-purpose backerboard member, and a novel method for producing it, which can be used intact for a single-lap siding panel, or can be broken along its weakening line for use with a double-lap panel. The continuity of the moisture barrier sheeting is not disrupted regardless of whether the backerboard is used in its single-lap or double-lap configuration, and the backerboard provides outstanding support for, and improved fit with, most siding panels with which it is assembled. The backerboard is relatively facile and inexpensive to produce, it is convenient to install, and is highly effective for its intended purposes. The construction ensures overlap of foil without undue waste, and it significantly reduces the tearing and wrinkling of foil that is normally encountered during direct application to an existing wall.

Having thus described the invention, what is claimed is:

1. A dual-purpose backerboard member comprising: an elongated insulating backerboard of cellular synthetic resin, said backerboard having a weakening line extending along the length, and substantially at the center of the height, thereof; and a coextensive barrier sheeting bonded to one face thereof, said barrier sheeting and backerboard being substantially free from bonding along a zone extending along and directly adjacent said weakening line, the width of said zone being greater than the thickness of said backerboard, so that said backerboard can be separated at said weakening line into two sections, and said barrier sheeting can readily be displaced from said backerboard along said zone so as to permit the adjacent edge portions of the separated sections to be overlapped without damage to or discontinuity in said barrier sheeting.

2. A double-lap siding panel assembly comprising an elongated double-lap siding panel comprised of upper and lower wall portions joined along their adjacent edges by a longitudinally extending, offsetting step portion; and an elongated backerboard member comprised of a backerboard of cellular synthetic resin and a coextensive barrier sheeting bonded to the face thereof adjacent said siding panel, said backerboard having two longitudinally extending sections with overlapping edge portions adjacent said siding panel step portion, said barrier sheeting having a web portion hingedly interconnecting said sections forming a barrier therebetween, said sections of said backerboard and sheeting bonded thereto being disposed in abutting surface contact with said siding wall portions.

3. The member or assembly of claim 1 or 2, respectively, wherein said weakening line is provided by scoring said backerboard.

4. The member or assembly of claim 3 wherein said resin is thermoplastic, and wherein said weakening line is produced by fusion of said resin.

5. The member or assembly of claim 1 or 2 wherein said barrier sheeting is aluminum foil.

6. In a method for the production of a dual-purpose backerboard member, the steps comprising: forming a weakening line in an elongated backerboard to provide for longitudinally severing said backerboard into two sections; and bonding a barrier sheeting to one face of said backerboard except along a zone extending along said weakening line with the width of said zone being greater than the thickness of said backerboard, whereby said backerboard can be separated at said weakening line into two overlapping sections and said barrier sheeting can readily be displaced from said backerboard along said zone to provide a connecting web, so as to permit the adjacent edge portions of the sections to be overlapped without damage to, or discontinuity in, said barrier sheeting.

7. In a method for the production of a double-lap siding panel assembly, the steps comprising: forming a weakening line in an elongated backerboard to provide for longitudinally severing said backerboard into two sections; bonding a barrier sheeting to one face of said backerboard except along a zone extending along said weakening line with the width of said zone being greater than the thickness of said backerboard; severing the backerboard member along said line of weakening into two sections; and assembling said backerboard member with an elongated double-lap siding panel comprised of upper and lower wall portions joined along their adjacent edges by an offsetting, longitudinally extending step portion, one of said backerboard sections being disposed against the inner surface of each of said panel wall portions with the adjacent edge portions of said sections in a generally overlapped relationship and with said barrier sheeting extending therebetween and substantially coextensively with said offset step portion of said panel.

8. The method of claim 6 or 7 wherein said backerboard is fabricated from a cellular synthetic thermoplastic resin, and wherein said steps of forming said line of weakening is effected by fusion of said resin.

9. The method of claim 8 wherein said backerboard is fused to form aligned elongated grooves in its opposite faces, which grooves cooperate to provide an area of reduced cross-section in said backerboard.

* * * * *